US005577942A

United States Patent [19]

Juselis

[11] Patent Number: 5,577,942

[45] Date of Patent: Nov. 26, 1996

[54] STATION KEEPING BUOY SYSTEM

[75] Inventor: Gregory J. Juselis, Portsmouth, R.I.

[73] Assignee: The United States of America as represented by the Secretary of the Navy, Washington, D.C.

[21] Appl. No.: 508,873

[22] Filed: Jul. 28, 1995

[51] Int. Cl.[6] ..... B63B 22/18

[52] U.S. Cl. ..... 441/21; 367/4

[58] Field of Search ..... 441/11, 21, 22; 114/144 B; 367/4

[56] References Cited

U.S. PATENT DOCUMENTS

| | | | |
|---|---|---|---|
| 2,941,492 | 6/1960 | Wilcoxon | 441/21 |
| 3,369,516 | 2/1968 | Pierce | 441/133 |
| 3,506,841 | 4/1970 | Majkrzak | 441/11 |
| 5,283,767 | 2/1994 | McCoy | 441/29 |

FOREIGN PATENT DOCUMENTS

| | | | |
|---|---|---|---|
| 170189 | 7/1988 | Japan | 441/21 |

*Primary Examiner*—Jesus D. Sotelo

*Attorney, Agent, or Firm*—Michael J. McGowan; James M. Kasischke; Prithvi C. Lall

[57] ABSTRACT

The present invention relates to a buoy system capable of maintaining a buoy in a fixed position on the ocean or another body of water without the use of an anchoring device. The buoy system includes a navigation control system for determining the position of the buoy relative to a desired station and a propulsion system for maneuvering the buoy to and maintaining it at the desired location or station. The navigation system receives positional information from a global positioning system antenna, and a compass. The propulsion system on the buoy may be formed by one or more thrusters.

17 Claims, 3 Drawing Sheets

STATION KEEPING BUOY SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a buoy system capable of maintaining the buoy in a fixed position on the ocean or another body of water without the use of an anchoring device.

(2) Description of the Prior Art

Sonobuoys are used to collect various types of data. For example, some sonobuoys collect data about the oceanic environment. U.S. Pat. No. 5,283,767 to McCoy illustrates such a sonobuoy. As shown in the '767 patent, the McCoy sonobuoy is a portable free drifting package having a sensor suite for collecting selected environmental data relating to the surrounding medium, a data storage capacity, a dive control system for positioning the package at a desired depth, a data communications system, a locating system for determining the position of the package, a power system for providing power to the various components of the package, and a systems controller.

Other sonobuoys are used to collect acoustic data about underwater targets. When used to collect data about an underwater target, the sonobuoy must have a known position in order to enable effective calculation of the position(s) of the underwater targets. The present method for deploying sonobuoys used in shallow water range tracking systems requires that a surface buoy and associated electronics be anchored at a surveyed position. Thus an anchoring device is provided to insure that the sonobuoy is maintained in a desired position.

Most sonobuoys currently in use consist of a receiving hydrophone, amplifying circuits, and a radio frequency (RF) modulation unit for transmitting data back to a data processing facility. These components are typically enclosed within a watertight floatation package. The mooring system presently used with these sonobuoys consists of a surface float and chain or line to an anchor on the bottom. Once the mooring system is in place, the sonobuoy is attached to the surface float via a tether line. The problems with this type of system are primarily associated with the mooring system. First, the location of the mooring has to be precise to be compatible with the geometry required for the tracking algorithm. This can be difficult especially in deep water. In deep water, errors in placement can be significant. Other problems become apparent when wave action, tide changes, ocean currents, and storms generate large dynamic forces that cause maintenance problems. Also large buoys create navigation hazards which, if in U.S. territorial waters, must be reported to the U.S. Coast Guard.

The depth of the water also generates limitations that make a mooring system impractical. When a mooring system is engineered for deep water, the physical size, weight and complexity of installation become major issues. A large vessel with the means of deploying heavy anchors, long mooring lines, and large surface floats is required.

In a deep mooring system, there is always an amount of slack on the mooring system line. This translates into variation in the position of the surface buoy at any given time. The amount of position variation is called a watch circle. The watch circle increases as the depth of the water increases. The watch circle that results can be very large, i.e., greater than 20 feet in diameter for 100 foot water depth. This then limits the accuracy that any tracking system can achieve. The inability to maintain sonobuoys in an accurately known position significantly degrades the performance of the system.

Still another problem is that the number of moorings required to cover a typical portable range is approximately sixteen. The time needed to acquire and assemble all the hardware for a typical range limits the portability and flexibility of the system. The mooring systems are typically deployed on a long term basis and must be maintained at sea.

Efforts have been made to develop different types of buoys having propulsion systems associated therewith. One such effort is exemplified in U.S. Pat. No. 2,941,492 to Wilcoxon. The Wilcoxon patent relates to a self propelled, remotely controlled buoy having a hydrophone associated therewith to make underwater sound measurements. The propulsion system for the buoy includes a propeller for pulling the buoy through the water and an electric motor for driving the propeller via a shaft. The buoy also includes a rudder arrangement for steering the buoy. The rudder arrangement includes a second electric motor for driving a pair of rudder members. Both the propulsion system and the rudder system are controlled by a remote operator. Neither system is designed for station keeping.

U.S. Pat. No. 3,369,516 to Pierce relates to a station to be maintained at a fixed location. The station includes a hollow buoyant structure, a stabilizing structure depending from the buoyant structure, and a radio antenna fixed to a mast attached to the buoyant structure. The station further includes a propulsion and navigation system for maintaining the station at a desired location. The propulsion system includes a plurality of propellers or jets located around the circumference of the buoyant structure. The navigation system is formed by a sonar system affixed to the bottom of the stabilizing structure. The sonar system interacts with a passive or active reflector connected to an anchor resting on the ocean floor. In this way, a navigational point of reference for controlling the propulsion system is provided.

The use of jets such as those in Pierce is undesirable because of the noise that they make. Ideally, a buoy being used to detect acoustic signals wants to operate in a quiet environment.

SUMMARY OF THE INVENTION

Accordingly, it is an object of the present invention to provide a buoy which can be used in oceanic or other water environments to gather acoustical data.

It is a further object of the present invention to provide a buoy as above which has a system for maintaining it at a desired station without the use of an anchoring device.

It is still a further object of the present invention to provide a buoy as above which can be used in open ocean tracking ranges and in remote range sites.

The foregoing objects are attained by the station keeping buoy system of the present invention.

In accordance with the present invention, the buoy system comprises a buoy having a housing which is at least partially submerged in a body of water and which is not restrained from movement. Preferably, the housing is watertight and formed from a non-corrosive material. The housing may include primary and secondary floatation chambers to provide the buoy with a desired set of floatation characteristics.

The buoy is further equipped with a system for keeping it at a desired location or station. This system includes a means for determining the real-time position of the buoy. This real-time position determining means is formed by a first antenna for receiving signals from a global positioning satellite and a differential global positioning system antenna for receiving signals from a remote beacon. The signals received by the antennae are transmitted to a navigation system which includes a compass and a computer programmed with the desired longitudinal and latitudinal information for the station at which the buoy is to be maintained. The computer generates a control signal representative of the difference between the real-time position of the buoy and the desired station position. This control signal is fed to a propulsion system for maneuvering the buoy to the desired station and for keeping the buoy at that station. In a preferred embodiment of the present invention, the propulsion system is formed by one or more thrusters designed for low radiated noise.

Other details of the system of the present invention, as well as other objects and advantages of the invention, are set forth in the following description and accompanying drawings wherein like reference numerals depict like elements.

DESCRIPTION OF THE PREFERRED EMBODIMENT(S)

Figure 1:
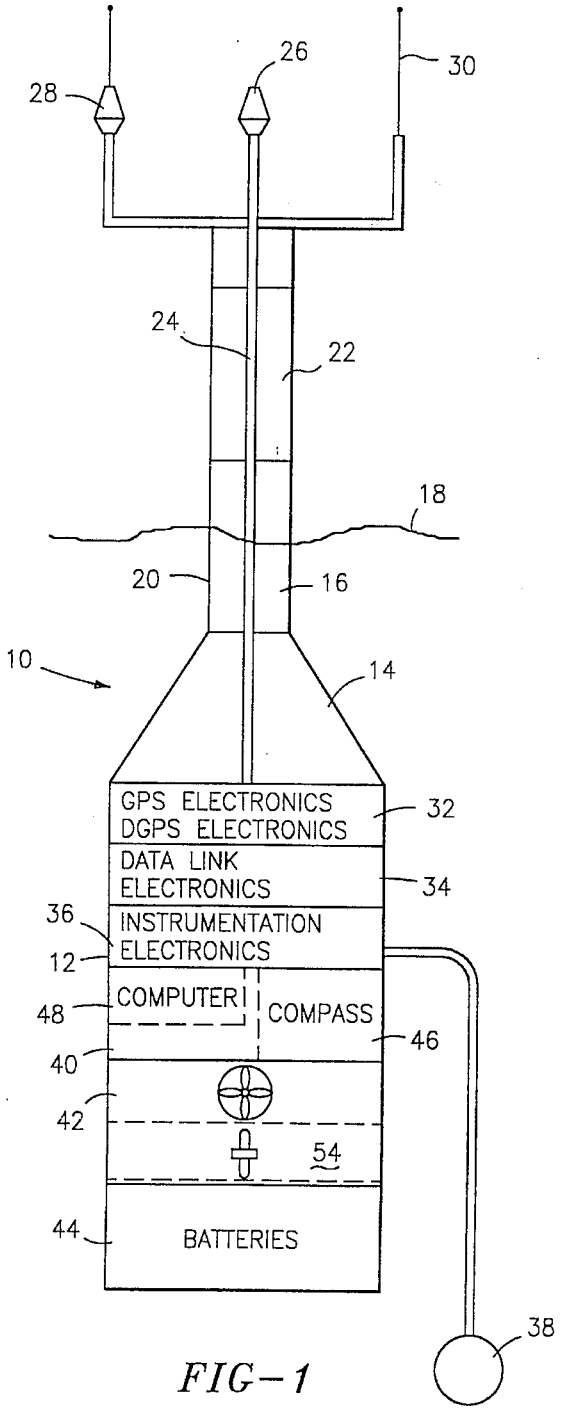
FIG. 1 is a schematic representation of a buoy system in accordance with the present invention.

Referring now to the drawings, the buoy system 10 of the present invention comprises a buoy having a housing 12 forming a watertight enclosure. Preferably, the housing 12 is formed from a non-corroding material such as aluminum, stainless steel, fiberglass, polyvinylchloride, or any other suitable plastic, metal, or composite material.

Floatation for the buoy is preferably provided by a primary floatation chamber 14 and a secondary floatation chamber 16, although a single floatation chamber system can be used if desired. Each of the floatation chambers 14 and 16 can be provided with a foam material (not shown) in an amount sufficient to provide a desired level of floatation. For example, the primary floatation chamber 14 can be provided with sufficient floatation material to provide approximately 90% of the total floatation required by the buoy and the secondary chamber 16 can be provided with sufficient material to provide approximately the remaining 10% of the total floatation required by the buoy. By providing such a floatation chamber configuration, the majority of the buoy 10 is allowed to remain under the surface or water line 18 of the ocean or other water body in which the buoy 10 is positioned.

Preferably, the secondary floatation chamber 16 is formed by an elongated cylinder 20 which has its longitudinal axis substantially perpendicular to the water surface 18. The secondary floatation chamber 16 is preferably that portion of the elongated cylinder 20 which extends below the water line 18. If desired, an additional floatation chamber 22 may be provided in that portion of the elongated cylinder 20 above the water line 18. If utilized, the floatation chamber 22 should have sufficient floatation material in it to provide a safety factor of about 50% of the total primary and secondary floatation.

The buoy 10 is further provided with a mast 24 which extends above the housing and preferably through the floatation chambers 14, 16 and/or 22. Attached to the mast 24 are an antenna 26 for receiving signals from a global positioning system (GPS) satellite, a differential global position system (DGPS) antenna 28 for receiving positional signals from a remote beacon, which may be land-based or sea-based, and an antenna 30 for forming a duplex radio frequency (RF) data link with an operator at a remote location. The DGPS antenna 28 is only essential to enhance the accuracy of commercially provided GPS signals. If error free GPS signals are available, then only GPS antenna 26 is necessary. The data link can be used to transmit acoustical data or other information acquired by the buoy. The data link can also be used to receive command signals for the buoy's onboard systems from the operator at the remote location. The floatation chambers 14, 16 and/or 22 serve to maintain the antennas 26, 28 and 30 in a substantially vertical and stable position.

The main body of the buoy 10 houses positioning system electronics 32 for the GPS and the DGPS systems, data link electronics 34 for the data link system, and instrumentation electronics 36 for the buoy's payload. Positioning system electronics 32 are joined to GPS antenna 26 and DGPS antenna 28 in order to determine location of buoy 10. Data link electronics 36 are joined to antenna 30 to receive remote commands. The payload 38 can comprise a hydrophone receiver for acquiring acoustical data about an underwater target or other types of sensors. The instrumentation electronics 36 typically include a pre-programmed computer (not shown) which acts as a digital signal processor for processing the data obtained by the payload 38. Once the data has been processed, it can be transmitted to the operator at the remote location via the data link or stored in an appropriate storage device. The details of the various electronic systems forming the electronics 32, 34 and 36 do not form part of the present invention and therefore will not be described in detail. Any suitable electronic systems known in the art may form the electronics 32, 34, and 36.

The buoy 10 further houses a navigational control system 40, a propulsion system 42, and one or more batteries 44 for the propulsion and electronic systems housed in the buoy. The navigation system 40 preferably includes a compass 46 such as a flux-gate compass. The compass 46 is used to resolve the orientation of the buoy 10 and to provide an indication or signal of the direction that the buoy 10 must travel for station keeping. The indication or signal generated by the compass 46 is fed to a navigational computer 48. Also fed to the computer 48 are positioning signals from positioning system electronics 32.

The navigational computer 48 can be pre-programmed with the desired location for the buoy and may receive information from the remote operator via the RF data link and data link electronics 36 about a desired station for the buoy 10. The computer 48 is also be programmed to determine from the positioning system electronics 32, and compass signals, the real-time position of the buoy 10. The computer 48 is then used to compare the real-time position of the buoy 10 with the desired buoy location and to generate a control signal which is representative of the difference between the real-time position and the desired buoy location and the direction in which the buoy 10 must be moved to reach the desired station and be maintained at that station. The computer 48 may comprise any suitable computer known in the art. Additionally, it may be programmed using any suitable programming language known in the art. The program used by the computer 48 and the type of computer used do not form part of the present invention.

The control signal generated by the computer 48 is fed to the propulsion system 42 which then maneuvers the buoy 10 to the desired location and maintains the buoy 10 at that location.

Figure 2:
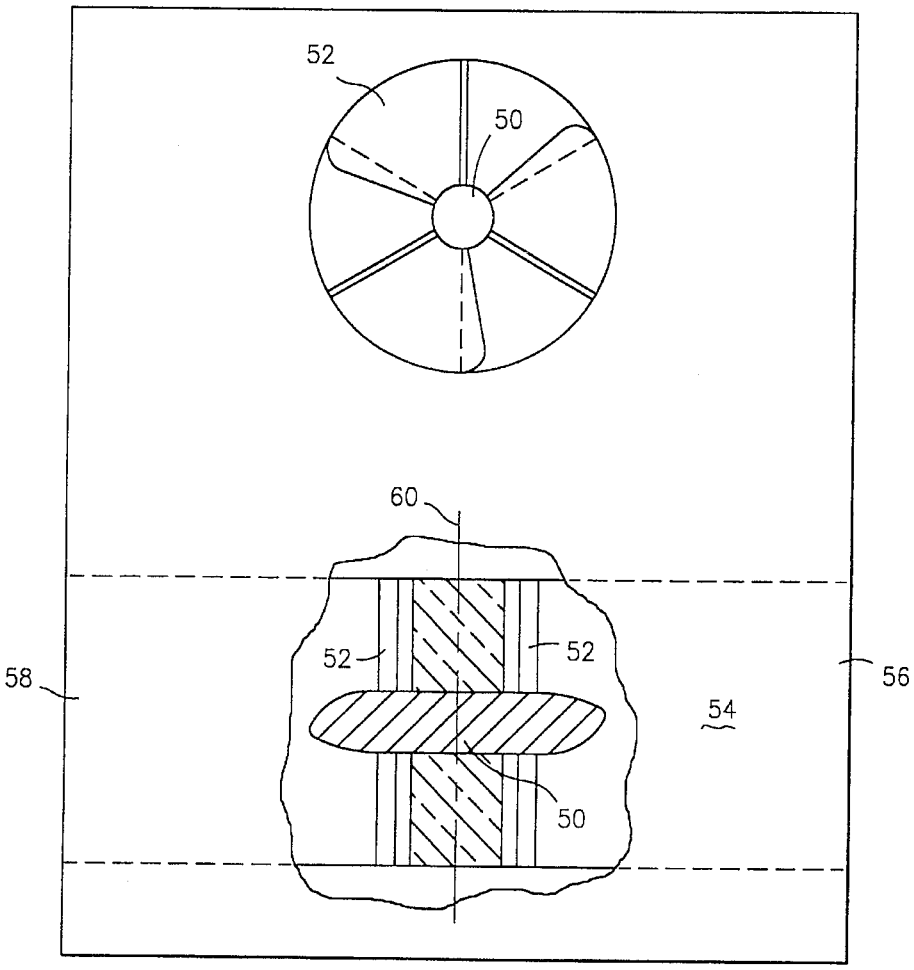
FIG. 2 is a schematic representation of a bi-directional thruster system to be incorporated into the buoy system of FIG. 1.

Referring now to FIG. 2, the propulsion system 42 may comprise a bi-directional vector thrust system powered by dual electric motors. The bi-directional vector thrust system has two submersible electrical motors 50 and impellers 52 associated with the motors 50. These motors 50 and impellers 52 are similar to electrical trolling motors. Each motor 50 and associated impellers 52 are mounted in a conduit 54 having two ports 56 and 58, one of which serves as an inlet port and the other of which serves as an outlet port. Each motor 50 is mounted in the conduit 54 in a fixed position. The impeller 52 is mounted upon motor 50 to allow it to drive water through conduit 54. The rate and direction of rotation of the motor 50 can be controlled by the computer 48. By operating both motors in tandem, the amount of thrust and the direction of the thrust generated by the system can be varied. As shown in FIG. 2, the conduits 54 housing the motors 50 are preferably arranged at a right angle to each other.

The thruster system should be large enough to provide enough thrust to compensate for the equivalent of about five knots of current induced hydrodynamic drag, plus about thirty knots of wind induced drag. The net drag determines the size and power of the thrusters required. Preferably, the thruster system is located at the center of hydrodynamic drag for the buoy.

Batteries for the thruster system may be selected according to the power requirements of the system. Preferably, the batteries have enough power for a sixteen hour operational cycle.

Figure 3:
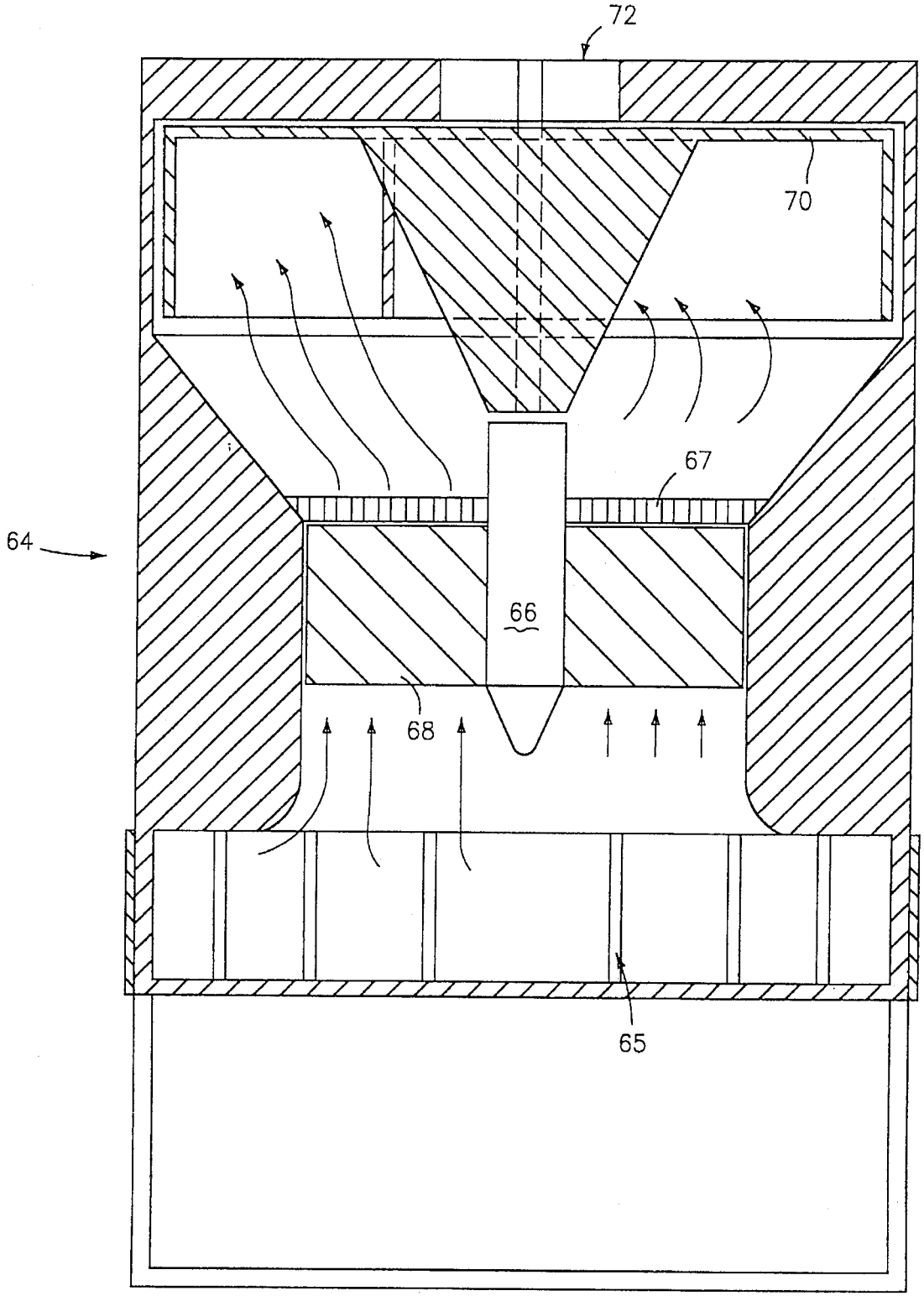
FIG. 3 is a sectional view of an alternative thruster system which can be incorporated into the buoy system of FIG. 1.
Figure 4:
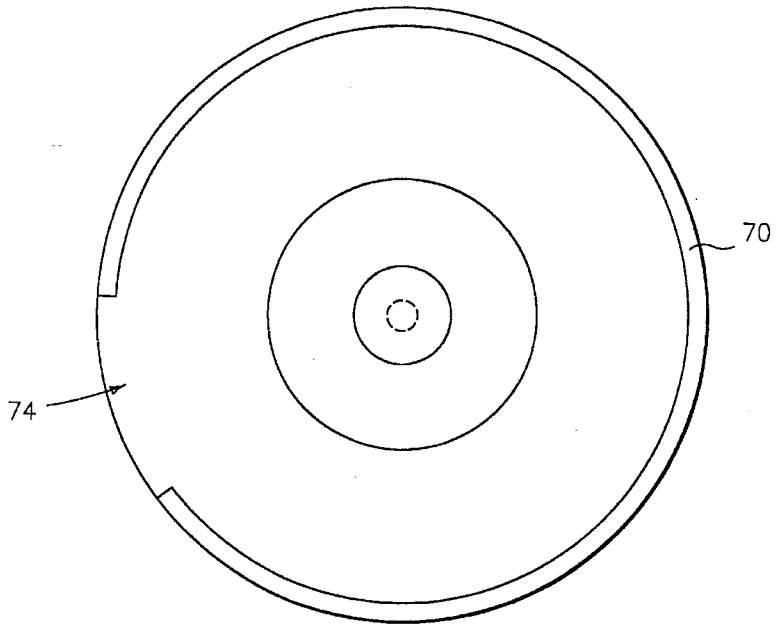
FIG. 4 is a bottom view of a directional vane used in the thruster system of FIG. 3.

In lieu of the bi-directional vector thrust system, a rotational vane thruster system 64 such as that shown in FIGS. 3 and 4 may be used. The rotational vane thruster system 64 has an inlet screen 65 through which fluid enters the system, a single electric motor 66 with a plurality of impellers 68, a counter-rotating vane 67 attached to the motor, a directional vane 70 and an electric direction control motor 72 for rotating the vane 70. As shown in FIG. 4, the directional vane 70 is circular in section and has an outlet 74 through which fluid is exhausted and thrust may be generated in a desired direction. When in use, the position of the outlet 74 is determined by the computer 48 which transmits a control signal representative of the desired direction for maneuvering the buoy 20 to the control motor 72. The propulsion system 42 should be designed for low radiated noise, optimal battery life and efficiency.

The buoy 10 may also include a power management system (not shown) for charging the various batteries onboard the buoy and for monitoring power consumption. The power management system should have the ability to shutdown any unnecessary subsystems for power conservation. The power management system may be any suitable power management system known in the art for accomplishing the foregoing objects. Its design does not form part of the present invention.

Figure 5:
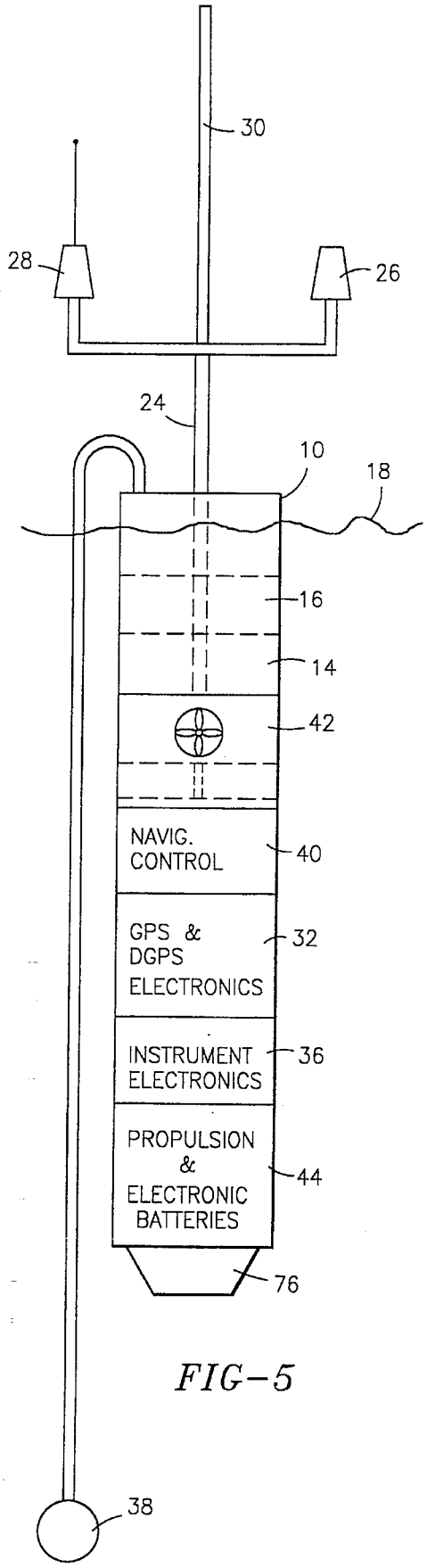
FIG. 5 is a schematic representation of an alternative embodiment of a buoy system in accordance with the present invention.

FIG. 5 illustrates another embodiment of a buoy in accordance with the present invention. One difference between this embodiment and the embodiment of FIG. 1 is the location of the propulsion system 42. In this system, the propulsion system 42 is located just below the floatation chambers and above the various electronic packages, navigation control system, and battery packages. This embodiment also includes a stabilizer fin 76 joined vertically to the bottom of buoy 10. When buoy 10 is subjected to a current or is far from its station, the buoy 10 is more efficient when using only one thruster. This fin 76 will make buoy 10 self orienting in the current. Fin 76 will also prevent buoy 10 from spinning in the current.

If desired, the propulsion system 42 also can be formed by a propulsion package which is secured to the bottom of the buoy housing.

There are numerous advantages to the buoy system of the present invention. One of these advantages is the ability to deploy accurately positioned buoys regardless of water depth. This makes open ocean tracking ranges or remote range sites possible. The buoy system is also advantageous in that it is portable. The buoy need only be programmed to whatever configuration is required, supplied with longitude and latitude data, and deposited in the water close to its intended location. Thereafter, the buoy will automatically maneuver to its intended location and keep station.

Still further, the time required to set up and deploy a range is greatly reduced. Daily operations need only to charge batteries, program station locations and deploy the buoys close to their stations. Since all setup parameters are handled by computer, setup errors are avoided. Utilizing a master setup program, the latitude, longitude, and data link parameters are downloaded to the individually addressable buoys.

Other advantages to the present invention are the absence of bulky mooring systems, the absence of hazards to navigation, and the lack of any need for surveyed range sites. The absence of a mooring system eliminates hazards to commercial ships, test vehicles, and submarines. The buoys of the present invention can be deployed and retrieved according to test requirements using a ship's crane or a similar system. Since the buoys are modular in nature, they will be easy to maintain and will facilitate repair.

The buoys of the present invention can be utilized in other applications and can be modified to act as tracking buoys to actively track targets and to relay their position. Furthermore, the buoys of the present invention can be used for other missions such as tracking a whale tagged with a transponder.

It is apparent that there has been provided in accordance with this invention a station keeping buoy system which fully satisfies the objects, means, and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A station keeping buoy system comprising:

a buoy having a housing which is at least partially submerged in a body of water;

a real time position determining means having a first antenna disposed on said buoy and joined to a receiver for receiving a global positioning signal;

said real time position determining means further having a differential global positioning system antenna joined to said receiver to correct global positioning signal error;

a navigation system disposed in said buoy and joined to said real time position determining means, said navigation system including a computer programmed with information about a preselected position for said buoy and capable of determining a positional difference between the real-time position of said buoy and a preselected position for said buoy, said navigation system generating a control signal representative of said positional difference; and a propulsor joined to said buoy and responsive to said navigation system control signal for maneuvering said buoy to said preselected position and maintaining said buoy at said preselected position.

2. A station keeping buoy system comprising:

a buoy having a housing which is at least partially submerged in a body of water;

a real time positioning determining means having a first antenna disposed on said buoy and joined to a receiver for receiving a global positioning signal;

a navigation system disposed in said buoy and joined to said real time position determining means, said navigation system including a computer program with information about a preselected position for said buoy and capable of determining a positional difference between the real time position of said buoy and a preselected position for said buoy, said navigation system generating a control signal representative of said positional difference;

said navigation system further including a compass for determining the orientation of said buoy and for providing directional information to said navigation system to use in generating said control signal; and a propulsor joined to said buoy and responsive to said navigation system control signal for maneuvering said buoy to said preselected position and maintaining said buoy at said preselected position.

3. The system of claim 2 wherein said propulsor comprises at least one thruster mounted to said housing.

4. The system of claim 3 wherein said at least one thruster is positioned at the hydrodynamic center of drag of said buoy.

5. The system of claim 3 wherein said propulsor comprises first and second thrusters arranged substantially perpendicular to each other, each said thruster providing bidirectional thrust in response to said control signal.

6. The system of claim 5 wherein said first thruster is positioned within a first conduit and said second thruster is positioned within a second conduit and said first and second conduits are substantially perpendicular to each other.

7. The system of claim 6 wherein said first and second thrusters are each controlled, with respect to each other, in direction and amount of thrust for providing thrust in response to said control signal to minimize said positional difference.

8. The system of claim 5 further comprising a stabilizer fin positioned on the bottom of and extending below said housing and oriented to prevent said buoy from spinning.

9. The system of claim 3 further comprising at least one battery joined to provide power to said propulsor, said real-time position determining means, and said navigation system.

10. The system of claim 2 wherein said propulsor comprises a rotational vane thruster having a motor and impellers attached thereto, a directional vane having an outlet for directing the thrust produced by said motor, and a direction control motor for rotating said directional vane, said motor and said direction control motor being joined to said navigation system for providing thrust in response to said control signal to minimize said positional difference.

11. The system of claim 10 further comprising at least one battery joined to provide power to said propulsor, said real-time position determining means, and said navigation system.

12. The system of claim 10 further comprising a stabilizer fin positioned on the bottom of and extending below said housing and oriented to prevent said buoy from spinning.

13. The system of claim 2 wherein said housing includes:

a primary floatation chamber for providing a majority of the total floatation of said buoy; and a second floatation chamber positioned above said primary floatation chamber for providing the remainder of the total floatation of said buoy, whereby a majority of said buoy remains under the surface of said water.

14. The system of claim 2 further comprising a mast extending from said housing to a position above the water line, said first antenna being mounted to said mast.

15. The system of claim 14 further comprising:

a radio frequency antenna mounted on said mast; and a receiver joined to said radio frequency antenna and said navigation system to provide command signals to said navigation system.

16. The system of claim 15 further comprising:

a payload positioned in said buoy for obtaining data from the surrounding body of water; and a transmitter joined to said radio frequency antenna and in communication with said payload for transmitting said obtained data.

17. The system of claim 16 wherein said payload comprises:

a hydrophone for acquiring acoustical data; and a data processor joined to said hydrophone and to said transmitter for processing said acoustical data.

* * * * *